US008944263B1

(12) United States Patent
Small

(10) Patent No.: US 8,944,263 B1
(45) **Date of Patent: *Feb. 3, 2015**

(54) PRESCRIPTION DRUG LOCK BOX

(71) Applicant: Steven Douglas Small, Novato, CA (US)

(72) Inventor: Steven Douglas Small, Novato, CA (US)

(73) Assignee: Steven Douglas Small, Novato, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/146,711

(22) Filed: Jan. 2, 2014

Related U.S. Application Data

(60) Provisional application No. 61/765,651, filed on Feb. 15, 2013.

(51) Int. Cl.

| | |
|---|---|
| ***A61J 1/00*** | (2006.01) |
| ***B65D 55/02*** | (2006.01) |
| ***E05B 37/02*** | (2006.01) |
| ***E05B 65/00*** | (2006.01) |
| ***E05B 73/00*** | (2006.01) |

(52) U.S. Cl.

CPC ..... *E05B 65/0014* (2013.01); *E05B 37/02* (2013.01); *E05B 73/00* (2013.01)

USPC ..... 215/206; 70/58; 70/166; 215/208; 215/230; 220/8

(58) Field of Classification Search

CPC . E05B 73/00; E05B 73/0005; E05B 73/0017; E05B 73/0023; E05B 73/0041; B65D 50/061; B65D 55/02; B65D 55/026; B65D 55/14

USPC ..... 70/58, 63, 163, 166; 215/206–208, 230; 220/8, 686, 737, 739

See application file for complete search history.

(56) References Cited

U.S. PATENT DOCUMENTS

| | | | | |
|---|---|---|---|---|
| 3,988,909 | A | 11/1976 | Catapano | |
| 4,227,388 | A | 10/1980 | Nigrelli | |
| 4,573,332 | A | 3/1986 | Ma | |
| 4,690,292 | A | 9/1987 | Henning | |
| 4,869,082 | A | 9/1989 | Appelbaum | |
| 4,991,729 | A | 2/1991 | Hunter | |
| 5,172,575 | A | 12/1992 | Fisher | |
| 5,277,325 | A | 1/1994 | Yan | |
| 5,284,262 | A | 2/1994 | O'Nan | |
| 5,427,266 | A * | 6/1995 | Yun | 220/377 |
| 5,833,087 | A * | 11/1998 | Pfeiffer | 215/230 |
| 6,059,132 | A | 5/2000 | Benjamin | |
| 7,107,803 | B1 | 9/2006 | Swanson | |
| 7,252,204 | B1 | 8/2007 | Small | |
| 7,600,648 | B2 | 10/2009 | Hammer | |

(Continued)

OTHER PUBLICATIONS www.thelockingcap.com.

(Continued)

*Primary Examiner* — Christopher Boswell

(57) ABSTRACT

This invention pertains to a prescription drug lock box consisting of a container and a detachable combination locking cover assembly used to secure the contents held within. The container has an integrally formed key post positioned above its open end. The tumblers of the cover assembly engage the key post and lock to it thus securing contents held within. When the indicia of the tumblers and correct unlocking code are in alignment with a marker, the cover assembly may be installed or removed.

5 Claims, 10 Drawing Sheets

(56) References Cited

U.S. PATENT DOCUMENTS

| | | | | |
|---|---|---|---|---|
| 7,681,422 | B2 | 3/2010 | Tonaltzin | |
| 7,866,505 | B2 | 1/2011 | Perlman et al. | |
| 8,020,415 | B2 | 9/2011 | Corbin et al. | |
| 8,201,705 | B2 | 6/2012 | Williamson | |
| 8,237,541 | B2 * | 8/2012 | Wang | 70/63 |
| 8,517,193 | B1 | 8/2013 | Small | |
| 8,662,330 | B2 * | 3/2014 | Simpson | 70/158 |
| 2006/0207958 | A1 * | 9/2006 | Hamer | 70/77 |
| 2009/0120898 | A1 * | 5/2009 | Hunt et al. | 215/230 |
| 2011/0174758 | A1 * | 7/2011 | Gonzalez Sanchez et al. | 215/206 |
| 2011/0210136 | A1 * | 9/2011 | Wang | 70/63 |
| 2013/0062303 | A1 * | 3/2013 | Serell | 215/206 |
| 2014/0008319 | A1 * | 1/2014 | Buxton-Dakides | 215/230 |
| 2014/0202978 | A1 * | 7/2014 | Hwang | 215/230 |

OTHER PUBLICATIONS www.lockmed.com.
www.flambeau-scriptsafe.com.
www.rxdrugsafe.com.

* cited by examiner

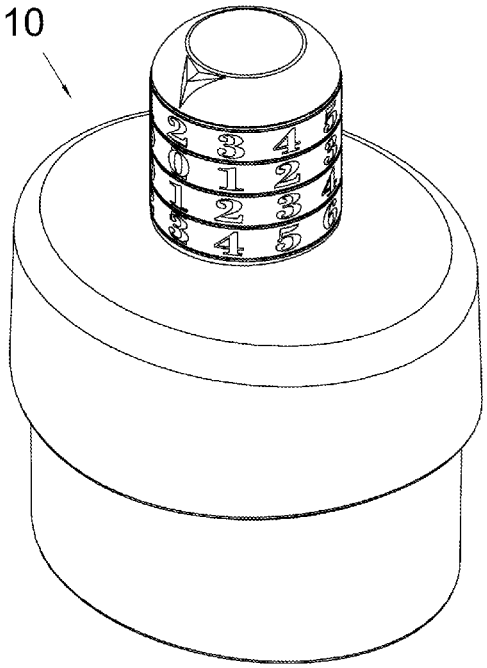
FIG. 1-A
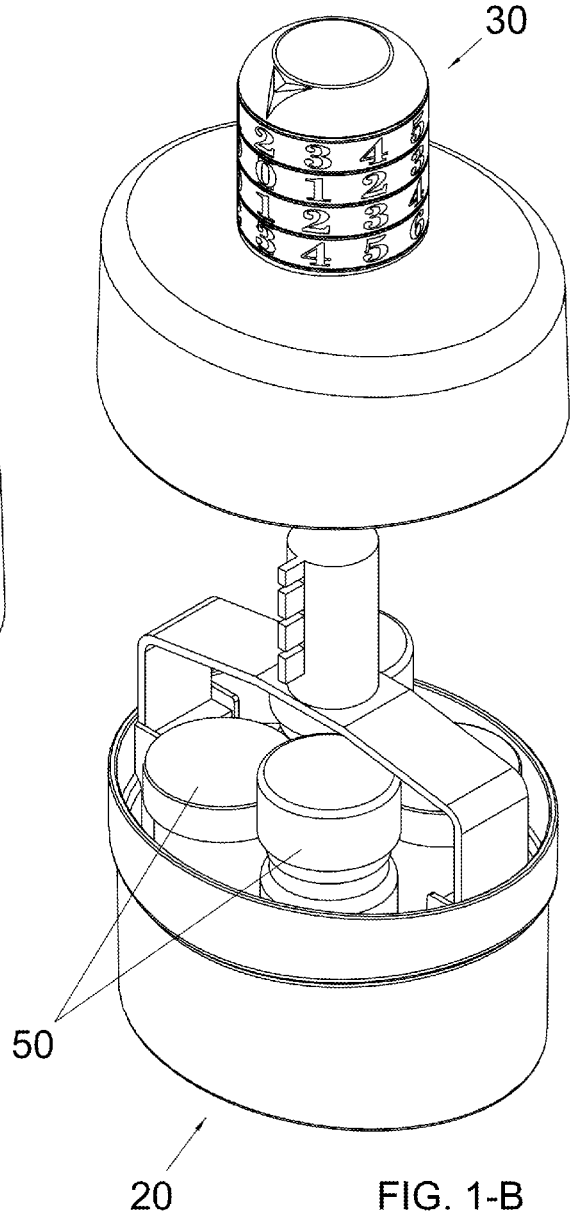
FIG. 1-B

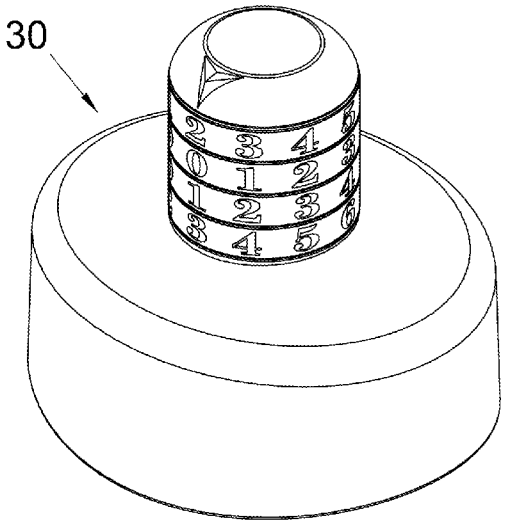
FIG. 2-A
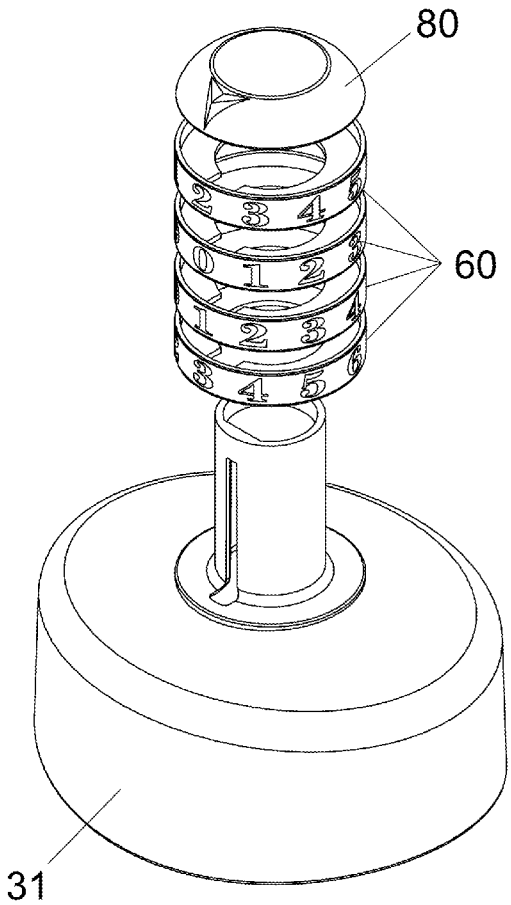
FIG. 2-B

FIG. 3-A
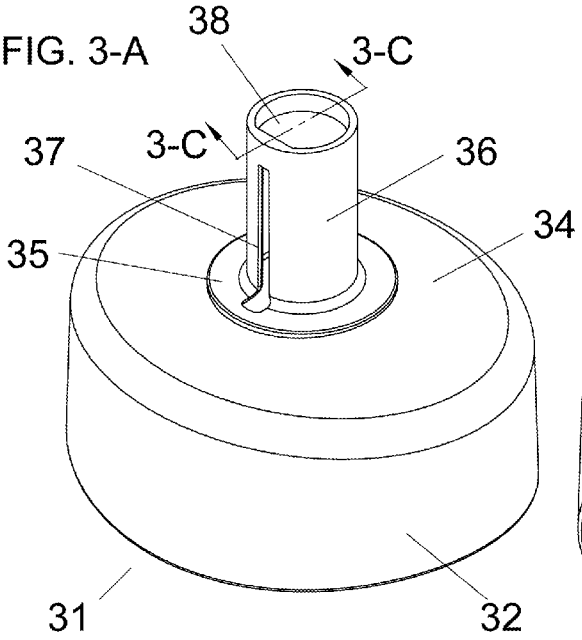
FIG. 3-B
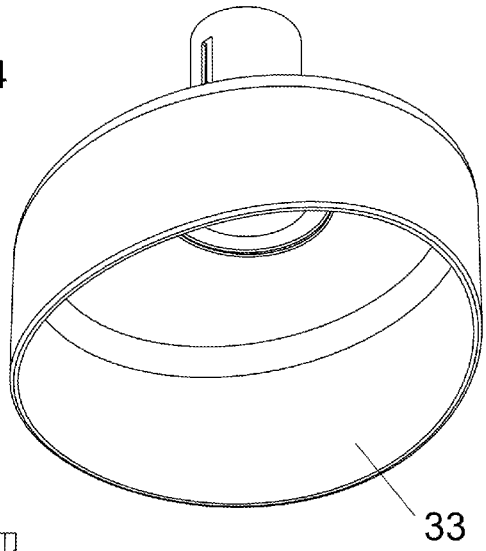
FIG. 3-C
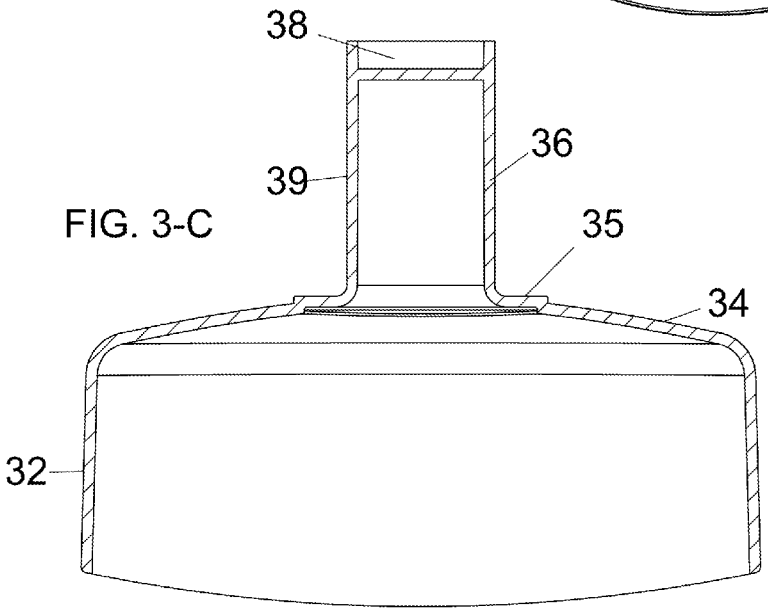

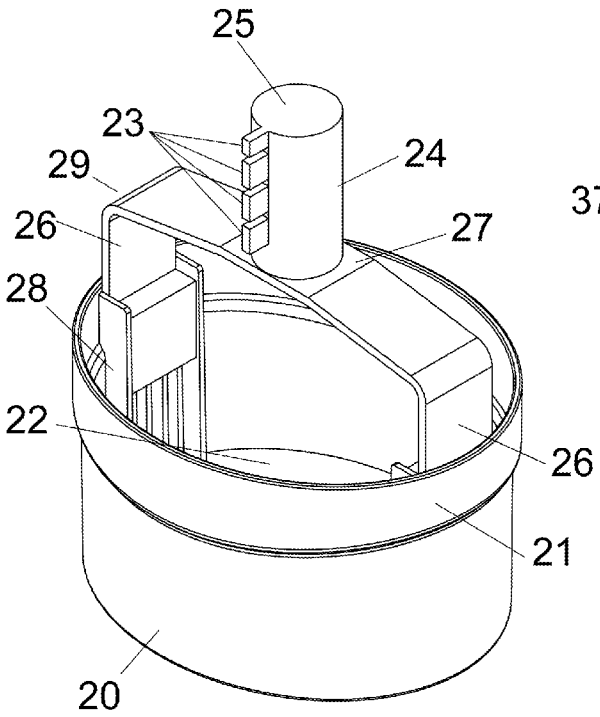
FIG. 4-A
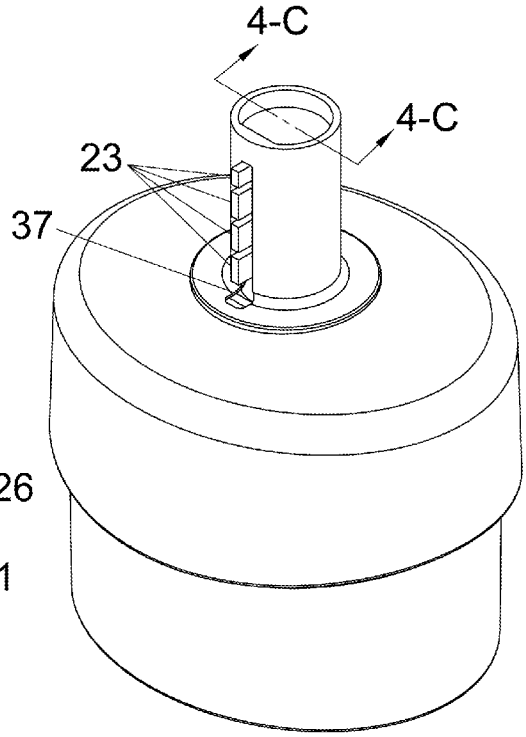
FIG. 4-B
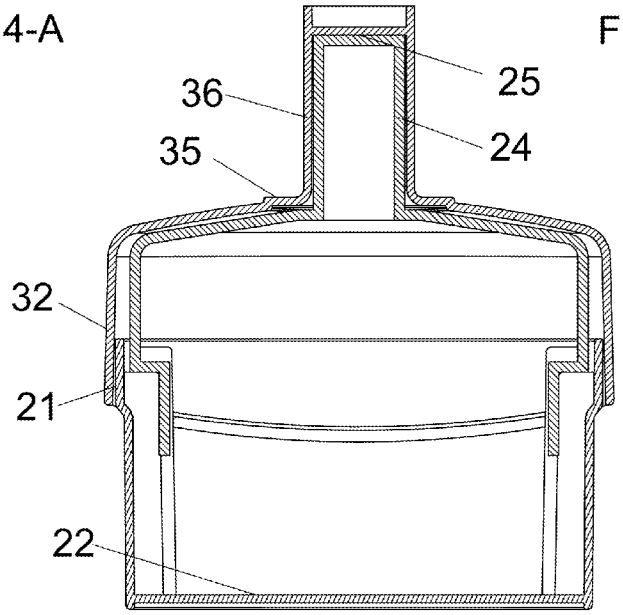
FIG. 4-C

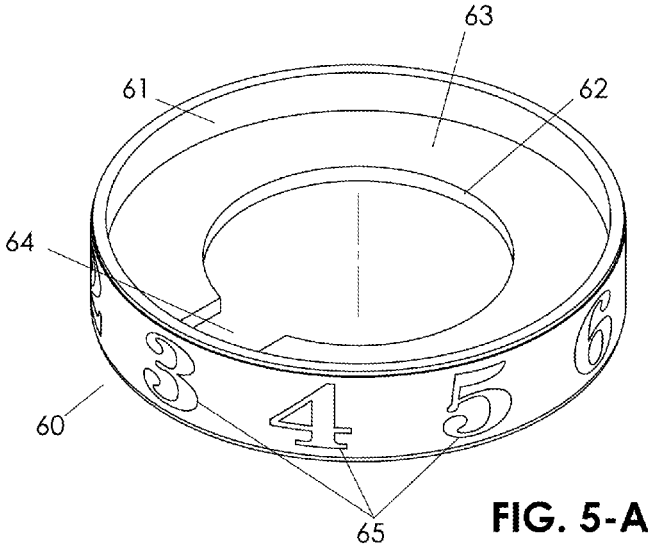
FIG. 5-A
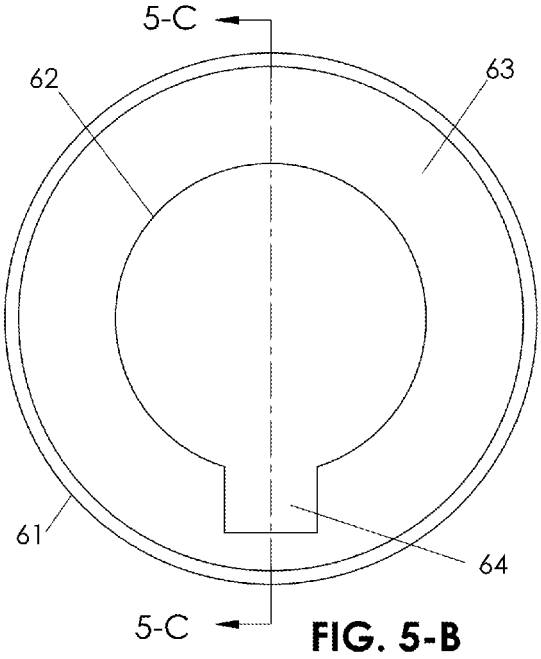
FIG. 5-B
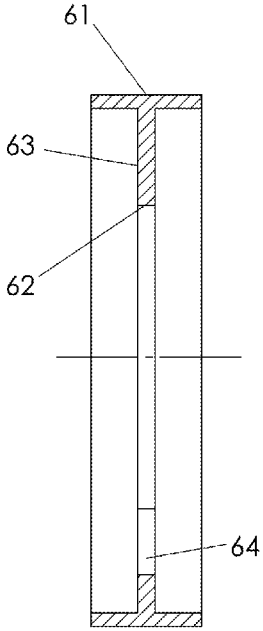
FIG. 5-C

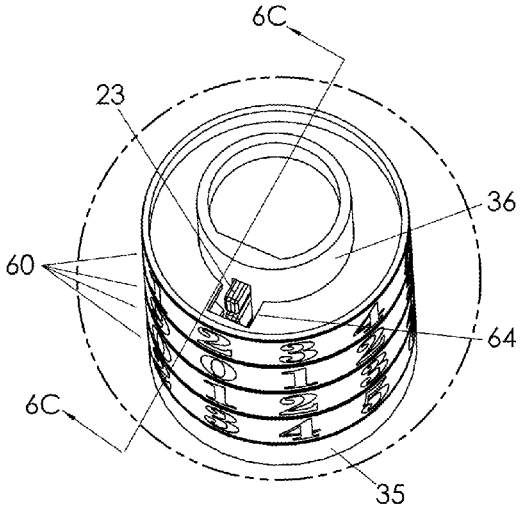
FIG. 6-A
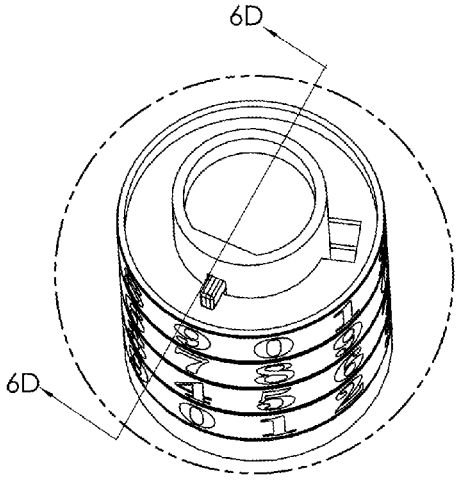
FIG. 6-B
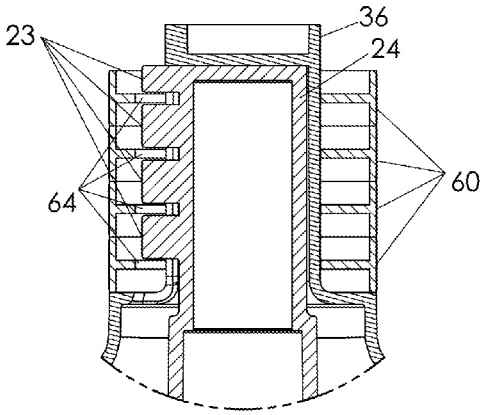
FIG. 6-C
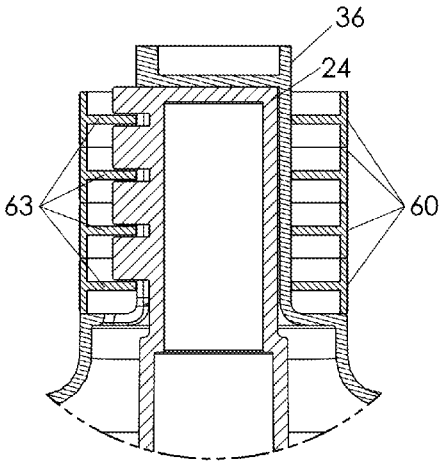
FIG. 6-D

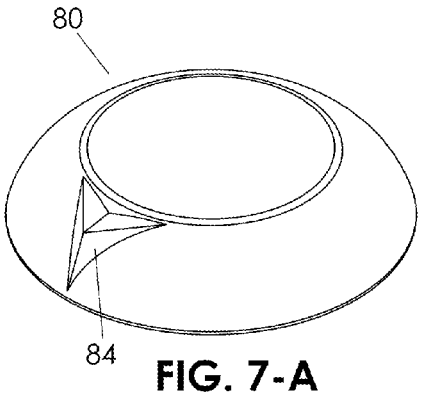
FIG. 7-A
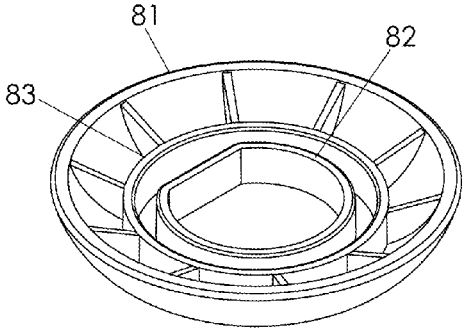
FIG. 7-B
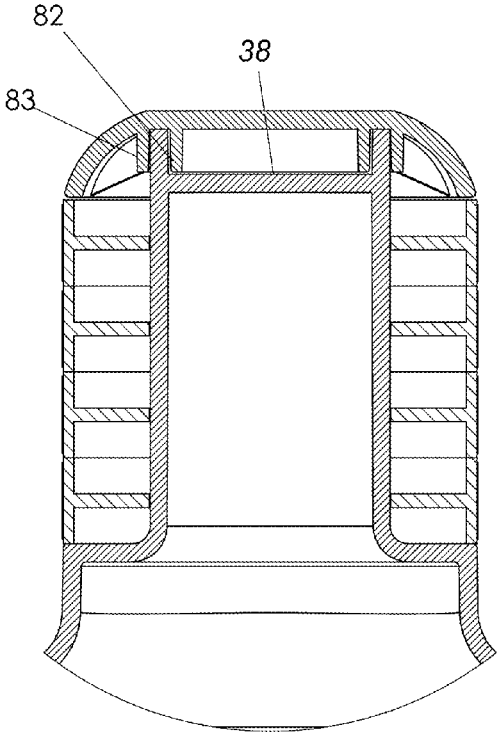
FIG. 7-C

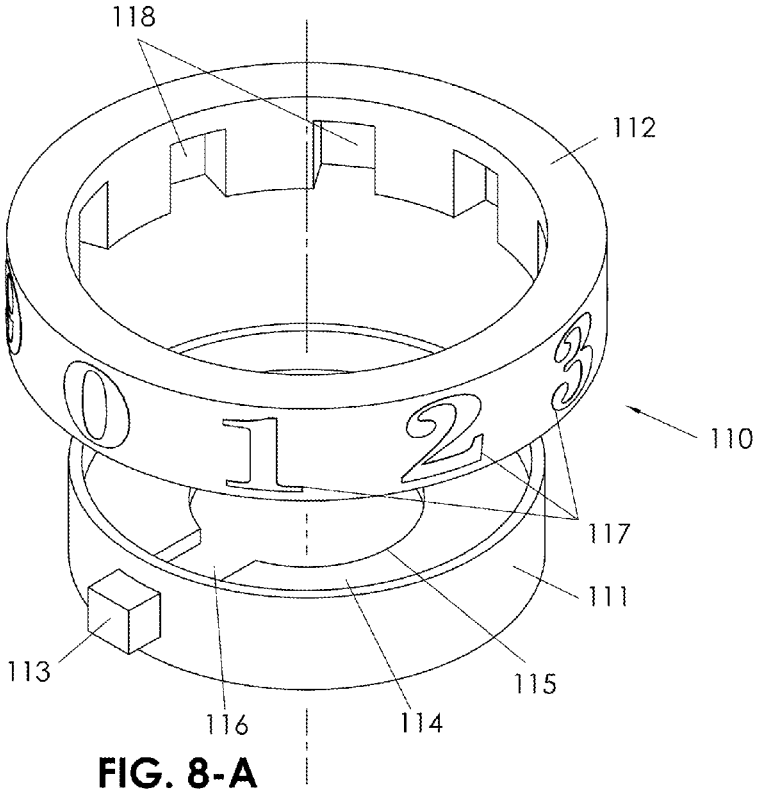
FIG. 8-A
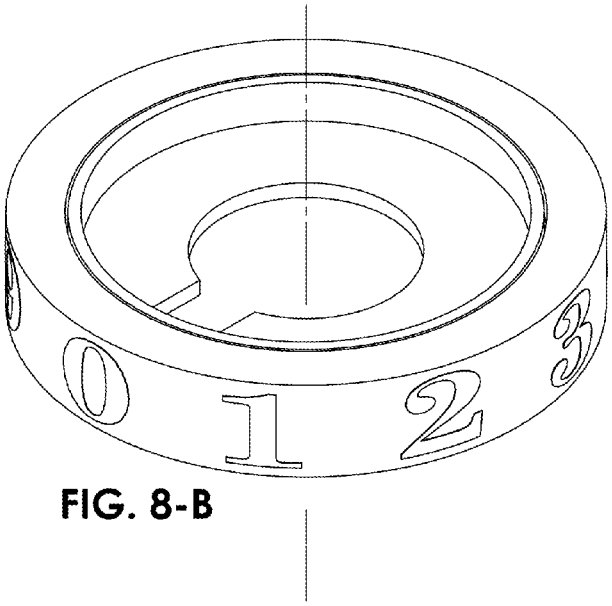
FIG. 8-B

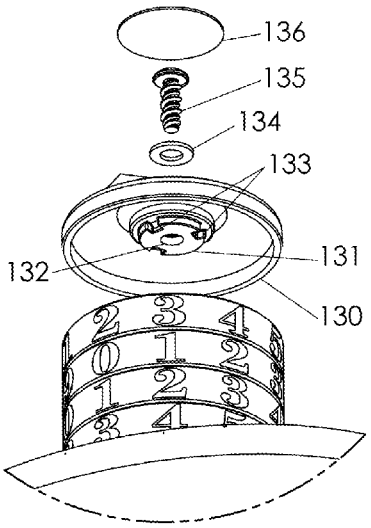
FIG. 9-A
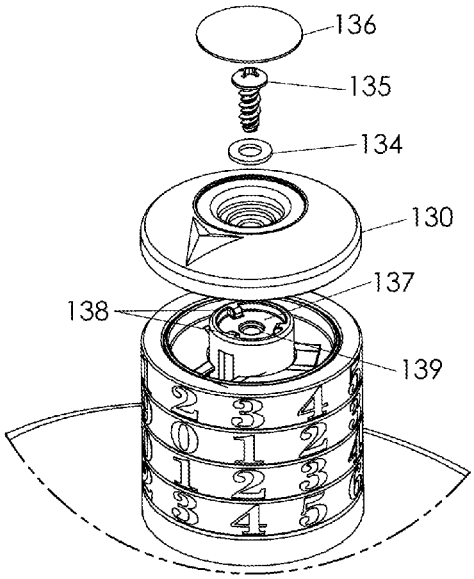
FIG. 9-B
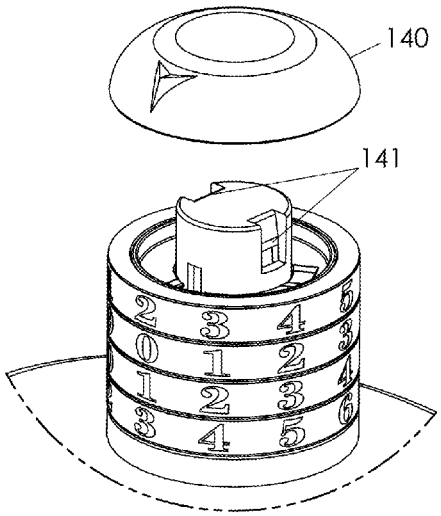
FIG. 9-C
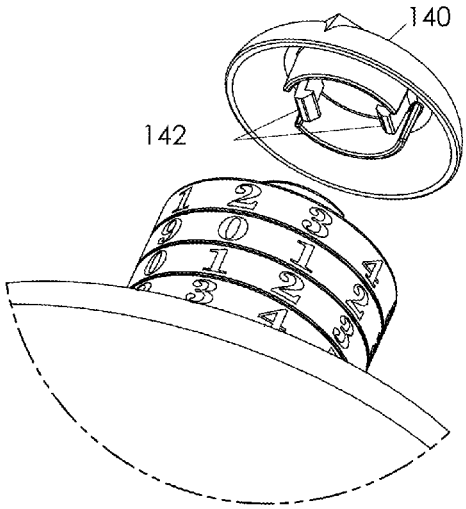
FIG. 9-D

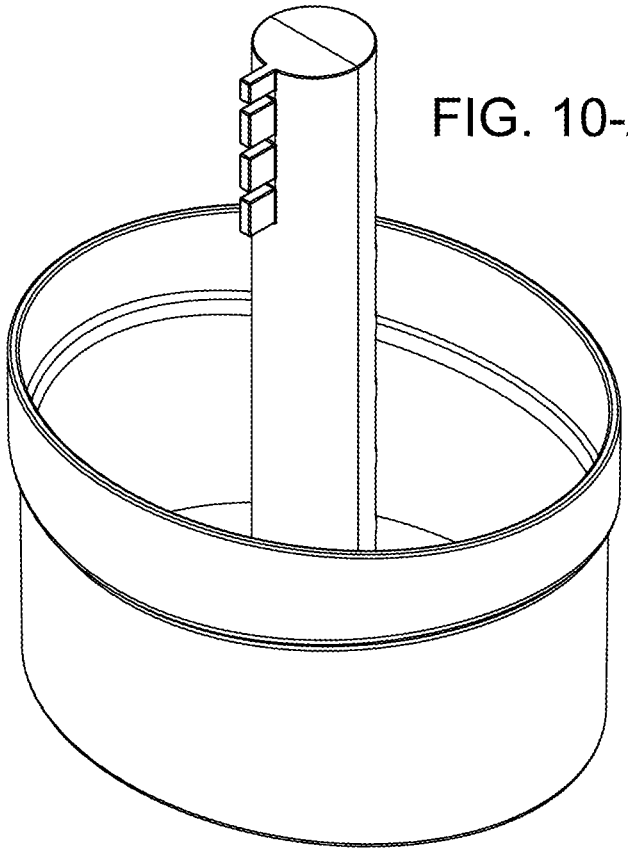
FIG. 10-A

PRESCRIPTION DRUG LOCK BOX

CROSS-REFERENCE TO RELATED APPLICATIONS

This application claims the benefit of PPA Ser. No. U.S. 61/765,651, filed 2013 Feb. 15 by the present inventor.

FEDERALLY SPONSORED RESEARCH

None

SEQUENCE LISTING

None

TECHNICAL FIELD

This invention relates to storage containers. In particular this disclosure relates to a prescription drug lock box that utilizes a detachable combination locking cover assembly that can secure a container and the contents held within.

BACKGROUND OF THE INVENTION

This invention relates to a prescription drug lock box which can be used for securing various items including but not limited to pharmaceuticals, hospital and office supplies, chemicals, household cleaning products, personal electronics, cell phones, jewelry, personal items and the like.

Its most significant application might be for better securing prescription drugs within the home. Misuse of pharmaceutical drugs is a significant problem in today's society. Drugs can often be stolen from the prescribed person without their knowledge. They are often taken from unsecured medicine cabinets, bathroom counters, kitchen cabinets, etc. In addition, each year, sadly, medicines can unfortunately fall into the hands of toddlers and small children who can ingest them resulting in illness and sometimes death. The main intent of this device is to provide a simple and convenient, low cost means of security to prevent easy free access and theft of prescription drugs. The device can have various sizes and capacities to hold different bottle shapes and sizes for pills, liquids, ointments, etc.

PRIOR ART

Cases with resettable combination locking hasps, such as used in briefcases or metal lock boxes, are examples of locking storage containers. Several companies currently manufacture such hinged lock boxes. U.S. patent D621,152, Lebow shows a locking medicine bag. U.S. Pat. No. 6,059,135, John James et al shows a lockable safety container. U.S. Pat. No. 4,854,448, Hair shows a child proof locking container for storing medicines. Electronic, biometric finger print reading, or programmable keypad entry devices are also currently available, some of which are designed to mount into existing medicine cabinets. Many patents exist for child proof closures as well as ones that use locking tumblers to secure a cap to a bottle. Such devices are described in U.S. Pat. No. 3,445,021 Johnson et al; U.S. Pat. No. 3,407,954 Miliis; D664,350 & U.S. Pat. No. 8,020,415 Corbin & Warner; D512,831 Chue; U.S. Pat. No. 5,284,262 O'Nan; U.S. Pat. No. 7,350,655 Belden, U.S. Pat. No. 5,277,325 Yan. Still other pill cases designs include U.S. Pat. Nos. 6,000,546 & 8,006,845, Noble et al; US 2005/0029155 A1 Edwards. U.S. Pat. No. 8,201,705, Williamson shows a cover that uses a combination lock to secure a dish. Other combination locking containers also include U.S. Pat. Nos. 7,252,204 & 8,517,193 Small, the inventor of this patent application. A transparent portable security case is described in U.S. Pat. No. 7,918,362, Schmitt.

OBJECTS AND ADVANTAGES

It is the object of the present invention to provide a prescription drug lock box that has the following advantages which are:

(a) to act as a deterrent or barrier to unauthorized access of pharmaceutical drugs;

(b) to provide an affordable solution for securing medications within the household;

(c) to provide a simple, mechanical locking container requiring neither batteries and electronics;

(d) to provide a device, easy to manufacture and with minimal number of working parts;

(e) to have design versions with enough storage capacity for holding larger quantities of packaged prescription drugs of various shapes and sizes.

(f) to provide a portable travel sized lock box for medications

Still further objects and advantages will become apparent from a consideration of the ensuing description and drawings.

SUMMARY

This invention pertains to a prescription drug lock box consisting of a container and a detachable combination locking cover assembly used to secure the contents held within. The container has an integrally formed key post positioned above its open end. The tumblers of the cover assembly engage the key post and lock to it thus securing contents held within. When the indicia of the tumblers and correct unlocking code are in alignment with a marker, the cover assembly may be installed or removed.

The container is a hollow part with uniform wall thickness having a flat horizontal bottom wall, a continuous vertical side wall, and open at the top. In the preferred embodiment, a curved bar with two legs is joined to opposing sides of the container's interior. The bar legs extend vertically from the side wall of the container, curve towards each other, and form a horizontal portion which is centered to the container and above the open end. The bar thus forms a closed rigid arch above the container's open end. From the center of the arch, an integrally formed cylindrical post extends further vertically. Projecting outwardly on the post's side wall is a linear array of tabs. The tab array is oriented in longitudinal direction from the top of the post. The tabs and post together represent a "key post" feature. The cover assembly and tumblers engage and lock to the key post. There are many methods for integrating and positioning a key post above the open container. For instance, in one alternate way, the key post could be formed on top of an integrally formed vertical column that projects upwardly from the center of the containers bottom wall. The presence of a central column would however take up some available space in the container. The bars and key post can be integrally molded or formed directly as features of the container where container, bars, and key post are injection molded or die cast as one single part. For ease of manufacture, and simpler injection molding, the preferred embodiment of this application shows the bars and post as being a separate rigid part that is bonded into a seat provided in the container. In another design variation, the bar could potentially attach to the container with a pivot on either side. With the bar able to swivel and rotate, the horizontal bar portion and key post could pivot out of the way with less obstruction to the container's opening.

The combination locking cover assembly consists of a cover, a set of locking tumblers, and a retaining cap. The cover is a hollow part with uniform wall thickness, having a continuous vertically oriented side wall, an upper wall, and fully open at the bottom end. Shape and cross-sectional profile of the cover's side wall concentrically matches and fits over the container's side wall. The cover and container nest and fit together, where the cover side wall overlaps and is outside of the container's side wall. In this manner the cover sheaths and closes off the container. The general form factor or horizontal cross-sectional profile of container and cover's side walls could be cylindrical, elliptical, rectangular, or of any shape. Illustrations of this application show the cross-sectional form factor as being elliptical. The shape and size of the cover provides clearance with the arched bar feature of the container when the device is fully assembled. A short protrusion extends vertically above the upper wall of the cover and creates a "tumbler seat" which is used to support the stack of tumblers. Projecting upwardly from the tumbler seat is a cylindrical shaft portion with a closed top end. A vertical key slot cuts through the tumbler seat and partially through shaft side wall. The cover's key slot provides clearance with the tabs of the key post and permits assembly and disassembly. A D-shaped profile counterbore is recessed into the top end of the shaft. The counterbore serves as a female mating feature used to assemble the retaining cap. The flat of the D-shape acts as an angular alignment feature in mating between the cap and cover. The inside diameter of the cover shaft has a close concentric fit and allows free insertion and extraction of the key post and tabs when cover assembly is either installed or removed. With cover assembly installed over the container, the key post tabs project outwardly past the shaft's outside diameter. The cover is vertically supported by the top of the key post. Each tumbler consists of a short cylindrical wall with its central axis oriented vertically. From the tumblers inner surface, and centered to the tumbler height, a horizontal wall or locking rib projects inwardly, terminating and leaving a hole at the center. A notch, or keyway opening, the width of which is equal to that of the cover's key slot, cuts through the locking rib wall. A set of indicia are equally spaced in a radial array on the outside diameter surface of tumbler. One of the indicia may be assigned as part of an unlocking code and is angular alignment and positioned directly in front of the keyway opening. The tumbler's inside diameter has close diametral fit with the cover shaft. A set of tumblers may be inserted onto the cover shaft, stacked above and supported by the tumbler seat. The tumblers may freely rotate on the cover shaft. The wall thickness of the locking rib is just slightly less than the gap height or spacing between the tabs of the key post. Discreet elevation of the stacked tumblers allows each locking rib to be centered with and have direct correspondence to a gap present between the tabs of the key post. An open channel for full insertion or extraction of key post is created when all tumbler keyways are in alignment with the cover's key slot. This open condition allows the cover assembly to be installed or removed from the container. Thus when fully assembled, the tumblers may rotate freely on the cover shaft with each locking rib engaging a gap between the tabs of the key post.

The retaining cap is used both to axially hold down and secure the stack of tumblers as well as to provide a location for aligning the tumbler indicia and unlocking code. The cap is a part with uniform wall thickness with top and bottom surfaces and a peripheral edge. The cap may have various shapes, have curvature, or may be simply flat or disc shaped. The cap's outer diameter fully covers the tumblers. An alignment indicator or "marker" is visible on the top surface of the cap. Projecting downwardly from the bottom surface of the cap is a D-shaped profile protrusion or male mating feature. The male mating feature fits into and provides alignment with the D-shaped profile counterbore or female mating feature on top of the cover shaft. Cover and cap may be press fit together via these mating features with a suitable high strength adhesive or solvent thus creating a strong bonded joint between the two and permanently capturing the tumblers to the cover. Note that the cap secures the tumblers to the cover but still allows them to freely rotate with minimal axial play. Other methods exist and are possible for securing the cap to the cover such as ultrasonic welding of plastics, mechanical fasteners, screws, retaining rings, etc as well as barbed plastic snap leg features, etc. With the cap aligned and bonded to the cover, the marker feature is positioned directly over the cover's key slot. Tumbler indicia may be rotated with the correct unlocking code displayed beneath the marker. In this unlocked condition the keyway openings of all tumblers are in alignment with the key slot of the cover and cover assembly may be installed or removed from the container. With the cover assembly placed over the container, rotation of any one tumbler from the unlocked condition causes the locking rib to intersect or engage into the gap of the key and defines a locked condition. In this locked condition, the cover can not be removed from the container and any contents held within are secured.

BRIEF DESCRIPTION OF THE DRAWINGS

FIG. 1-A shows an oblique view the preferred embodiment of the device.

FIG. 1-B shows an exploded view of the device with several medications placed inside.

FIG. 2-A shows an oblique view of the cover assembly.

FIG. 2-B shows an oblique exploded view of the cover assembly.

FIG. 3-A shows an oblique view looking down at the cover.

FIG. 3-B shows an oblique view looking beneath the cover.

FIG. 3-C is a cross-sectional view showing the cover side walls, tumbler seat, and shaft.

FIG. 4-A shows an oblique view of the container with bar and key post.

FIG. 4-B shows a detailed view of the key feature penetrating from the cover shaft.

FIG. 4-C shows a cross-sectional view of the container assembled to the cover.

FIG. 5-A shows an oblique view of the tumbler

FIG. 5-B shows a top view of the tumbler.

FIG. 5-C shows a cross-sectional view of the tumbler.

FIG. 6-A shows an oblique view of the tumblers stacked on to the cover with container post inserted and tumblers aligned to the open position.

FIG. 6-B shows an oblique view of the tumblers stacked on to the cover with container post inserted and tumblers aligned to a locked position.

FIG. 6-C shows a cross-sectional view of the tumblers stacked on to the cover with container post inserted and tumblers aligned to the open position.

FIG. 6-D shows a cross-sectional view of the tumblers stacked on to the cover with container post inserted and tumblers aligned to a locked position.

FIGS. 7-A and 7-B show oblique views of the retaining cap.

FIG. 7-C shows a sectional view of the retaining cap and its attachment to the cover shaft.

FIG. 8-A shows an exploded view of inner and outer two piece tumbler set embodiment.

FIG. 8-B shows inner and outer two piece tumbler set embodiment assembled and nested together.

FIGS. 9-A and 9-B show oblique exploded view of hardware as means of attaching retaining cap.

FIGS. 9-C and 9-D show oblique exploded view of snap leg features as means of attaching retaining cap.

FIG. 10-A shows an alternate embodiment for the container with a post projecting centrally from bottom surface

DRAWINGS

Reference Numerals

| DRAWINGS - - REFERENCE NUMERALS | |
|---|---|
| 10 prescription drug lock box | 25 top of key post |
| 20 container | 26 bar legs |
| 21 side wall of container | 27 flat horizontal portion of bar |
| 22 bottom wall of container | 28 ribs for assembly of split bar |
| 23 linear array of tabs | 29 bar with integral key post |
| 24 cylindrical post | 30 cover assembly |
| 31 cover part | 115 inside diameter of inner tumbler |
| 32 cover side wall | 116 keyway of inner tumbler |
| 33 open bottom end of cover | 117 indicia of outer tumbler |
| 34 upper wall of cover | 118 recesses on outer tumbler |
| 35 tumbler seat | 130 retaining cap, screw assembly version |
| 36 cylindrical shaft of cover | |
| 37 vertical key slot of cover | 131 male assembly feature, retaining cap, screw assembly version |
| 38 female assembly feature | |
| 39 outside diameter of shaft | 132 clearance hole for screw, screw assembly version |
| 50 prescription drug bottles | |
| 60 locking tumbler | 133 alignment slots, screw assembly version |
| 61 cylindrical wall of tumbler | |
| 62 inside diameter of tumbler | 134 washer, screw assembly version |
| 63 locking rib of tumbler | 135 screw |
| 64 keyway opening | 136 tamper-proof adhesive label, screw assembly version |
| 65 set of indicia | |
| 80 retaining cap | 137 female assembly feature, cover shaft, screw assembly version |
| 81 peripheral edge of retaining cap | |
| 82 male assembly feature of retaining cap | 138 alignment ribs, screw assembly version |
| 83 supporting cylindrical wall of retaining cap | 139 screw hole, screw assembly version |
| 84 marker | 140 retaining cap, snap leg assembly version |
| 110 two piece tumbler set | |
| 111 inner tumbler | 141 side relief and slot feature, snap leg assembly version |
| 112 outer tumbler | |
| 113 rectangular tooth | 142 snap legs of retaining cap, snap leg assembly version |
| 114 locking rib, inner tumbler | |

DETAILED DESCRIPTION

FIGS. 1-A Through 7-D, Preferred Embodiment

A preferred embodiment of the container of the present invention is illustrated in FIGS. 1-A through 7-C. The present invention provides a prescription drug lock box 10 shown generally in FIG. 1-A. FIG. 1-B shows an exploded view of the device consisting of a container 20, and a combination locking cover assembly 30. The container can hold any number of items including, but not limited to, prescription drug bottles 50.

FIG. 2-A shows an oblique view of the cover assembly 30. FIG. 2-B shows an exploded view of the cover assembly consisting of cover part 31, a set of locking tumblers 60, and a retaining cap 80.

FIG. 3-A shows an oblique view of the cover part 31 from above. FIG. 3-B shows an oblique view of the cover part from beneath. FIG. 3-C shows a cross-sectional view of the cover. The cover is generally a hollow thin walled part of uniform wall thickness, having interior and exterior surfaces, a vertically oriented side wall 32, an upper wall 34, and a fully open bottom end 33. The side wall can be tapered or be straight. The general form factor of the cover can be cylindrical, elliptical, rectangular, etc. The shape or horizontal cross-sectional profile of the cover is intended to have a concentric fit with the container. A short cylindrical protrusion, centered to the cover's vertical axis, extends upwardly from the upper wall of the cover. A flat planar wall formed at the top of this protrusion and creates a tumbler seat 35. The diameter of the tumbler seat is approximately equal to or greater than the outside diameter of the tumblers. Further extending vertically from the center of tumbler seat is a cylindrical shaft 36 with outside diameter 39. A vertical key slot 37 cuts through tumbler seat and partially though shaft. Recessed into the top end of the shaft is a D-shaped profile counterbore, or female assembly feature 38, which used to align and assemble the retaining cap.

FIG. 4-A shows an oblique view of the container 20. A bar 29 has an integrally formed cylindrical post 24 at its center. With more complicated injection molded tooling, it is possible that the container, bar, and cylindrical post could be molded as a single part. The illustration presented in this preferred embodiment however shows use of two parts joined or bonded together—container 20 and a bar with integral key post 29. The container has a flat bottom wall 22 and side wall 21 and is open at the top end. A series of ribs 28 on opposing sides of the container create a seat for the two bar legs 26 to be bonded. The bar securely bonded to the container creates a strong rigid arch above the container's open end. From the flat horizontal portion of the bar 27, an integrally formed cylindrical post 24 further extends vertically. The longitudinal axis of the post is aligned with the central vertical axis of the container. Projecting outwardly from the post's side wall is a linear array of tabs 23. The tabs are arrayed in downward vertical direction relative to the top of the post. The tabs and post together represent a "key post" feature on the bar. FIG. 4-B shows close up details of the tabs penetrating through the cover's key slot. The key slot profile of the cover is sized for clearance with the tabs on the key post. Cross-section FIG. 4-C shows the key post concentrically nesting and having a close diametral fit within the cover's shaft. The cover is vertically supported by the top of the key post 25. The cross-section also shows the overlap between the cover side wall 32 and container side wall 21.

FIGS. 5-A through 5-C shows isometric, top, and section views of a locking tumbler 60. The tumbler has a cylindrical wall 61 with a vertically oriented central axis and having inner and outer surfaces and planar surfaces at top and bottom respective ends. From the tumbler's inner surface, a horizontal annular locking rib 63, positioned at mid-height with respect to the cylinder, extends partially inwardly creating hole at the center. The hole formed defines the inside diameter of the tumbler 62. The tumbler's inside diameter is sized for a close concentric fit with outside diameter of the cover shaft. The thickness of the locking rib is less than the gap or height between the tabs on the container post. A notch intersecting and removing material from the locking rib wall creates a keyway opening 64. The keyway opening is equal in width to the key slot opening on the cover. Similarly, it is sized for clearance all around with the tabs on the key post. A set of indicia 65 are spaced equally in a radial arrangement on the outside diameter surface of the tumbler. These indicia may be applied to the tumbler in any number of ways including, but not limited to, silk screening, painting, hot stamping, mold textures, embossing or debossing, application of labels, etc. Indicia applied via adhesive backed labels represent one way for allowing personal code selection as well as re-combination. A select, predetermined indicia character, representing one character of an unlocking code, has alignment with, and is positioned directly in front of the keyway. The present embodiment shows uses the numerals 0 through 9 as the indicia. The number of indicia used could vary. Symbols, letters, colors, Braille, etc. are examples of other types of indicia that could potentially be used as well. As shown in FIG. 5A, the number "3" is angularly aligned with and directly in front of the tumbler keyway. In the example shown, the number "3" would be associated as being one digit of an unlocking code. Thus a set a set of tumblers can be inserted on to the cover shaft, stacked above and supported by the cover's tumbler seat, and rotate freely about the shaft. The tumblers can be rotated such that their keyways are aligned with the cover's key slot, thus creating an open channel into which the key post may be freely inserted or extracted.

FIG. 6-A shows locking tumblers 60 assembled onto the cover shaft 36 and resting on the cover's tumbler seat 35, tumbler keyways 64 aligned with tabs 23 and in an unlocked condition with unlocking code "2-0-1-3" shown. FIG. 6-B shows the tumblers rotated to a locked condition where locking ribs of tumblers intersect between gaps of the key post. FIG. 6-C shows a cross-section of the tumblers assembled and positioned in the unlocked condition with tumbler keyway openings 64 in vertical alignment with the tabs 23. FIG. 6-D shows a cross-section of the tumblers rotated to a locked condition with where the tumbler locking ribs 63 are engaged in the gaps between tabs of the key post thus interlocking the cover to the container. Note that the discreet height of each positioned tumbler stacked on the cover places the locking ribs at the same elevation and centered to the gaps in the container key. As previously mentioned, sufficient clearances exist for the locking ribs to travel freely in between the tabs of the key. Likewise, there is sufficient diametral clearance for the tumblers to freely rotate on the cover shaft.

FIGS. 7-A and 7-B show and top and bottom oblique views of the retaining cap 80. FIG. 7-C shows cross-section details of the cap attachment. The purpose of the retaining cap is to both axially hold down and secure the stack of tumblers as well as to provide a location for aligning the tumbler indicia and unlocking code. The cap is a generally a thin walled part of uniform thickness with top and bottom surfaces and peripheral edge wall 81. It may have various shape or curvature or be flat and disc shaped. Its peripheral edge fully covers the tumblers. Projecting downwardly from the bottom surface of the cap is a male assembly feature 82 that has a D-shaped cross-sectional profile. This protruding male feature is sized to nest into and align with the female assembly feature of the cover shaft. A supporting cylindrical wall 83 that fits over the cover shaft's outside diameter may be included to provide additional strength to the attachment. Cover and cap may be bonded together via these mating features with a suitable high strength adhesive or solvent thus creating a bonded joint between the two and permanently capturing the tumblers to the cover. With the retaining cap assembled there is close but sufficient space between the retaining cap and tumbler seat for the locking tumblers to rotate freely without excessive axial play. Note that there are many other means for attaching the cap to the cover post besides adhesive or solvent bonding. For instance if plastic is utilized, ultrasonically welding or heat staking could be utilized. Other means for attachment could include use of mechanical hardware such as screws, retaining rings, locking snap leg features. Some of these alternatives will be discussed in a following alternate embodiment section. Shown in FIG. 7-A is an alignment indicator or marker 84 located on the top surface of the cap. With the tumblers assembled, the cap can be joined to the cover. The D-shaped mating features of the cover shaft and cap provide alignment and position the marker directly above the cover's key slot. Tumbler indicia may be rotated with the correct unlocking code aligned beneath the marker. In this unlocked condition the keyway openings of all tumblers are in alignment with the key slot of the cover and cover assembly may be installed or removed from the container. With the cover assembly placed over the container, rotation of any one tumbler from the unlocked condition causes the locking rib to intersect or engage between a gap of the key and defines a locked condition. In this locked condition, the cover can not be removed from the container and any contents held within are secured.

Two Piece Tumbler Set, Alternate Embodiment

Other embodiments of the tumblers might allow the unlocking code to be selectively chosen rather than pre-assigned. FIGS. 8-A and 8-B show a two piece tumbler set 110 consisting of an inner tumbler 111 and an outer tumbler 112. Both tumblers have equal height and are annularly shaped. The inner tumbler has the ability to concentrically nest within the outer tumbler. The inner tumbler has a single rectangular tooth 113 protruding radially from its outside diameter. An annular locking rib 114 protrudes radially inward from the inside surface. The locking rib is centered in height, with respect to the inner tumbler. The central opening created by the locking rib represents the inside diameter 115. A notch cut through the locking rib creates a keyway 116. The keyway is annularly positioned directly behind the tooth feature. The keyway profile has clearance with the tabs on the container post.

The outer tumbler has indicia 117 equally spaced in a radial arrangement on the outside diameter surface. Directly behind each of the indicia, formed on inside surface, are recesses 118 that are suitably sized to accept the tooth of the inner tumbler. With the tooth feature on the inner tumbler having the ability to fit and index behind any of the indicia on the outer tumbler, the two piece tumbler set permits any of the indicia to be assigned as part of the unlocking code and be in alignment with the keyway.

Alternative Means for Attachment of Retaining Cap

Of the various means for attaching the retaining cap to the cover shaft, FIGS. 9-A through 9-D show details of two possible methods. FIGS. 9-A and 9-B show attachment of a retaining cap 130 using a washer 134 and a screw 135 which assembles through a clearance hole 132 in the male protruding assembly feature 131 of the cap. Alignment slots 133 or relief cuts accept male alignment ribs 138 in the counterbore or female assembly feature 137 of the cover shaft. The counterbore has a hole in the center 139 into which the screw can fasten. Once the retaining cap is assembled, a tamper proof seal 136, backed with high bond adhesive, may be place on top of the cap to cover the screw. Additionally, a security or "one-way" screw might be used instead of a standard flat head or Phillips head recess to prevent removal of the screw.

FIGS. 9-C and 9-D show a retaining cap 140 with snap legs features 142 projecting from underside of the part. The plastic snap legs would assemble into side relief and slot features 141 of the cover post, thus providing means to retain the cap to the cover shaft.

Alternative Means for Positioning the Key Post Above Container Opening

FIG. 10-A shows an alternate embodiment for container with the key post integrally formed on the bottom base wall and projecting upwards along the center vertical axis of the part.

CONCLUSION, RAMIFICATIONS, AND SCOPE

The previous descriptions and drawings illustrate various embodiments for the device. Each variation has its own merits and advantages. The drawings and descriptions above do not imply or suggest any specific dimensions, wall thickness, or materials. Likewise exact values for fits, allowances, tolerances, etc. are not specified. The device could cold have larger size to secure items such as household cleaners, chemicals, among others. Accordingly, the reader will see that the prescription drug lock box of this invention can secure the contents of any number items held within. With knowledge of correct unlocking code, the end user can easily align the combination on the tumblers to the cap marker and remove the cover assembly having quick and easy access to items held within. The device provides a level of security and privacy to prevent others from gaining unauthorized access. The device can have several embodiments and sizes that are suitable for different applications, storage capacities, etc. The preferred embodiment suggests thin walled injection molded plastics, however other materials could be used such as formed sheet metal, die cast metals, etc. should an application require greater strength and security. The invention can be configured for minimal use of parts with single piece tumblers. Likewise, an embodiment using an inner and outer tumbler set would permit unlimited resetting of the unlocking code. Various means for applying the indicia are available. Indicia applied by means of adhesive backed labels to single piece tumblers allows for personal code selection and resetting as well. Although the description and drawings show use of four tumblers, the design could be altered for use with any number of tumblers —3, 5, etc. The form factor of the container may be altered to various shapes. The cover and container could interface in many different ways. For example the overlap of the parts could be the reverse of what is shown, where the container's side wall overlaps on the exterior of the cover's side wall. In brief, the device minimally consists of a container, a cover, a set of locking tumblers, and a retaining cap. Thus the scope of the invention should be determined by the appended claims and their legal equivalents, rather than the examples given.

What is claimed is:

1. A prescription drug lock box comprising:

(a) a container;

(b) a cover;

(c) a plurality of locking tumblers; and (d) a retaining cap;

said container being a hollow part with uniform wall thickness having a flat horizontal bottom wall, a vertical side wall, and open at the top, interior volume suitably sized for acceptance of items including but not limited to pharmaceutical drug bottles, said container having structural means for supporting a cylindrical post positioned centrally above open top end, the post being vertically oriented and located on central vertical axis and located above said container, the post having a linear array of tabs projecting from its outside diameter surface and extending vertically downward from top end of the post, the tabs having discreet spacing or gaps between each other, where cylindrical post and tabs define a key post;

said cover being a hollow part with uniform wall thickness, having a vertically oriented side wall, an upper wall, and fully open at the bottom, cover side wall sized for close concentric fit with container side wall, where cover side wall fits outside of container side wall, said upper wall of cover further having a flat horizontal surface formed defining a tumbler seat, said cover further having a cylindrical shaft portion extending vertically from said tumbler seat, the shaft having a closed wall at top end, said cover having a vertical longitudinal cut penetrating through said tumbler seat and partially through shaft side wall thus creating a key slot, width of said key slot being sized for clearance with tabs of said key post, where inside diameter of the shaft and key slot are sized to permit insertion and extraction of key post, the top end of cover shaft further having means for aligning, attaching, and securing said retaining cap, whereby said cover may be fully assembled over said container, where said key post may nest inside of the cover shaft and provide vertical support to said cover, where the key post tabs project through key slot and beyond the outside diameter of the cover shaft, and where length of assembled cover outside of said container provides an overlap between their respective side walls and sheaths or closes off the open end of said container, said locking tumblers being annularly shaped and having a short cylindrical outer wall, axis of which is vertically oriented, tumbler further having a planar horizontal wall or annular locking rib centered with respect to the tumbler's height and extending inwardly from inside surface of the cylindrical wall, the locking rib terminating at a circular opening at the center of the tumbler thus defining an inside diameter of the tumbler, the locking rib having a notch or portion of its wall section removed thereby creating a keyway opening, where profile of the keyway is sized for clearance with the tabs of said key post, where the inside tumbler diameter is just greater than outside diameter of cover shaft, where the thickness of the locking rib wall is just less than the gap or spacing between tabs of said key post, said locking tumbler having means for acceptance of programmable indicia onto the outer diameter surface, wherein assigned indicia may be aligned with and positioned in front of the keyway, where assigned indicia represents characters of an unlocking combination code used with the device, whereby with unlocking code selected and indicia assigned to all tumblers, tumblers may be inserted on to the cover shaft and stacked above and supported by said tumbler seat, wherein resulting elevation of stacked tumblers places locking ribs in direct vertical alignment and centered with respect to corresponding gaps between tabs of said key post, said retaining cap having uniform wall thickness with a circular perimeter, the diameter of cap's peripheral edge being equal to or greater than outside diameter of the tumblers, the cap having features providing means for alignment with and attachment to the top end of the cover shaft, whereby the attached cap captures and secures assembled tumblers, said retaining cap further having a marker visible on it top surface, whereby said marker is in direct alignment with cover's key slot, and wherein said cover, set of tumblers and retaining cap together comprise a combination locking cover assembly;

whereby an unlocked condition is defined as all tumblers positioned with assigned indicia and unlocking code aligned beneath said marker on the cap, thus resulting in all tumbler keyways being in alignment with said key slot and tabs of key post, and where cover assembly may be freely inserted onto or extracted from said key post, and where a locked condition is defined by rotation of at least one or more tumblers where locking ribs engage gaps between tabs of said key post, whereby in said locked condition, the cover can not be removed from the container and any contents held within are secured.

2. A prescription drug lock box of claim 1 wherein:

said programmable indicia are adhesive backed labels with indicia printed on top surface, where the label and printed indicia may be applied to and wrapped around the tumbler thereby allowing any indicia to be assigned as part of an unlocking code and aligned with the keyway.

3. A prescription drug lock box of claim 1 wherein:

said cover shaft has a D-shaped profile recessed female counterbore pocket formed on its top closed end and said retaining cap has a matching D-shaped profile male protrusion extending from its bottom surface, where size of mating features permit a press fit between the two features, and whereby adhesive may be applied to mating features to permanently bond the cap to cover shaft securing tumblers, and where D shaped profiles provide required alignment between cap and cover and position said marker directly above said key slot.

4. A prescription drug lock box of claim 1 wherein:

said retaining cap is plastic and has two snap leg features formed on its bottom surface, and cover shaft has two slotted openings on its side wall, whereby when cap is installed onto cover shaft, snap legs engage and are received into slotted openings thus providing means for attachment between cap and cover, and width of snap legs and slotted openings provide proper orientation of marker to keyway slot.

5. A prescription drug lock box of claim 1 wherein:

means for attaching cap to cover shaft is achieved by use of mechanical fasteners.

* * * * *